United States Patent [19]

Mendleski

[11] Patent Number: 4,646,214

[45] Date of Patent: Feb. 24, 1987

[54] MINIATURE COAXIAL LIGHTING ASSEMBLY

[76] Inventor: Ronald J. Mendleski, 1651B 18th St., Santa Monica, Calif. 90404

[21] Appl. No.: 817,499

[22] Filed: Jan. 9, 1986

[51] Int. Cl.[4] ..... F21V 9/00; F21V 29/00; A47G 33/16

[52] U.S. Cl. ..... 362/294; 362/362; 362/293

[58] Field of Search ..... 362/294, 362, 293, 296, 362/311, 366

[56] References Cited

U.S. PATENT DOCUMENTS

| | | | |
|---|---|---|---|
| 3,299,884 | 6/1967 | Moore et al. | 362/294 |
| 4,004,143 | 6/1977 | Good et al. | 362/294 |
| 4,321,659 | 3/1982 | Wheeler | 362/294 |
| 4,360,862 | 11/1982 | Strasser et al. | 362/362 |
| 4,479,173 | 10/1984 | Rumpakis | 362/294 |
| 4,546,420 | 10/1985 | Wheeler et al. | 362/294 |

*Primary Examiner*—Raymond A. Nelli
*Attorney, Agent, or Firm*—J. E. McTaggart

[57] ABSTRACT

A miniature lighting instrument for high quality architectural and display purposes features a sectionalized coaxial configuration. A base body, available with either a side- or rear-entry mounting adaptor, either fixed or swivel, is threadedly coupled to a midsection body available with a choice of smooth surface, lateral cooling ribs or fluted cooling ribs. The midsection body encloses an optical quality low voltage prefocused reflector type lamp. A selection of front barrels is available for threadedly coupling onto the front of the midsection body. The selection includes a long barrel for narrow-beam spotlighting, a short barrel for wide-beam floodlighting, a side-throw barrel for ultra-wide-angle floodlighting, and a projector barrel assembly with a front mounted lens and adjustable threaded mid-coupling for focusing. The many combinations made available by flexible interchangeability allow a lighting designer to customize the light instrument for particular tasks and to create novel and unusual artistic lighting display effects.

17 Claims, 6 Drawing Figures

MINIATURE COAXIAL LIGHTING ASSEMBLY

FIELD OF THE INVENTION

This invention relates to lighting fixtures for decorative effects in residential and commercial environments. More particularly it relates to stylized miniature lighting instruments adaptable to a wide variety of special architectural and display lighting treatments with requirements ranging from well-defined, intense illumination over small areas in some instances, to uniform wide-angle illumination in other instances, and requiring additional capabilities for creating special artistic effects such as image projection. The architecturally-oriented sector of the field of lighting addressed by this invention increasingly demands levels of quality and performance beyond the capabilities and scope of lighting fixtures available heretofore.

DESCRIPTION OF PRIOR ART

Presently available lighting fixtures in the field of this invention are usually so bulky that they are aesthetically unacceptable for many architectural and display purposes. Generally, their field of illumination is uneven, they are incapable of adapting to both wide- and narrow-beam modes, and the boundaries of the illuminated areas are unclear and uneven due to fringing effects resulting from optical shortcomings of the lamps used, particularly when their filaments are operated at power line voltages and are not of optical quality.

A common expedient to avoid the cost of accurate and efficient reflector lenses is the use of high wattage lamps despite their heat and power consumption disadvantages.

A particular problem arises where several light fixtures in a common project must perform a variety of different tasks, some flooding entire walls with light, other highlighting small areas with narrow-beam spots, yet all of the housings must be style coordinated. Often, either the housing style co-ordination or the lighting effectiveness must be compromised because the product line of lighting hardware available from any one source lacks the versatility to cope with the variety of lighting tasks.

General-purpose miniature lighting fixtures which can be readily adapted to perform as graphic image projectors have been virtually unavailable heretofore.

In many lighting situations, where ordinary unfiltered incandescent lamps are used, and especially if simple reflection is used for intensification, excessive heat projected along with the beam of light may damage or destroy the material being illuminated.

Dissipation of heat is always of concern in incandescent lamp housings, and can become intensified when filters are used to intercept some of the spectrum since the intercepted energy must be dissipated at the housing. To avoid dangerous tempertures, peripheral risks and premature lamp failures, lighting apparatus of prior art has often resorted to bulky, unsightly heat dissipators and even forced air blowers which would be entirely unacceptable in the particular field of the present invention.

It is a primary object of this invention to overcome the aforementioned drawbacks with the introduction of a miniature light assembly which is optically superior to existing light fixtures for architectural and display lighting, and which is readily adaptable to different lighting requirements ranging from narrow-beam spots to a variety of wide-beam applications.

It is a further object of this invention to introduce a compact lighting instrument in which a functional system design approach has combined successful solutions to the mechanical, optical, thermal and aesthetic problems cited, in an elegant sectionalized configuration featuring unusual ease of assembly and interchangeability of components while providing excellent optical performance and heat dissipation along with uncompromised high quality of construction and appearance.

It is a further object of the present invention to provide a basic lighting unit which in combination with a selection of interchangeable components will provide unprecedented versatility in assembling a variety of decorative miniature spotlights, floodlights, and special purpose luminaires which are readily adapted to have further capabilities as projectors of graphics, logos and the like, to produce focused images and light patterns, and to serve as conditioned light sources for fiber-optics systems.

SUMMARY OF THE INVENTION

The present invention has overcome the above-mentioned drawbacks by combining the advantages of a highly developed, optical grade prefocused integral reflector type lamp and a coaxial configuration in which the lighting system is sectionalized into three threadedly-coupled elements;

(1) a base body which at least partially encloses a lamp socket, and accepts a mounting adaptor,
(2) a midsection body which encloses the lamp, and
(3) a front barrel which defines the beam geometry and houses an optical processing disk which may be a filter, diffuser, fixed or adjustable iris, special lens or clear protective lens.

The lamp is made available with several reflector-lens options ranging from narrow-beam to wide-beam.

The base body is made available in two versions, one accepting the mounting adaptor at the rear, the other at the side.

The mounting adaptor is made available in a fixed tubular version or in a swivel version.

The midsection body is made available with a smooth finish or with cooling ribs in either lateral or fluted style.

The front barrel is made available in different lengths depending on the required beam width. Other front barrel options include an ultra-wide-angle side-throw configuration for floodlighting purposes, an adjustable-focus projector barrel assembly, and a fiber-optic coupler.

The three basic elements thread together readily, making assembly and retrofitting extremely quick and easy. Projector barrels are fitted with a threaded mid-coupling to provide focus adjustment by rotating the front section of the barrel.

DETAILED DESCRIPTION

Figure 1:
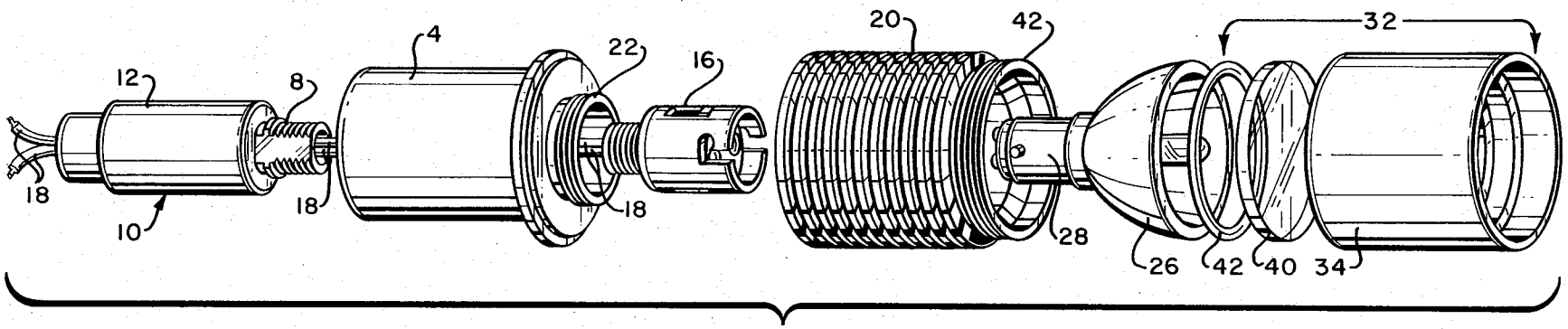
FIG. 1 is an exploded view showing the component parts of a lighting instrument illustrative of this invention in its preferred embodiment, configured with a rear-mounted swivel adaptor, a laterally-ribbed midsection body and a short barrel for producing a wide-angle light beam.
Figure 2:
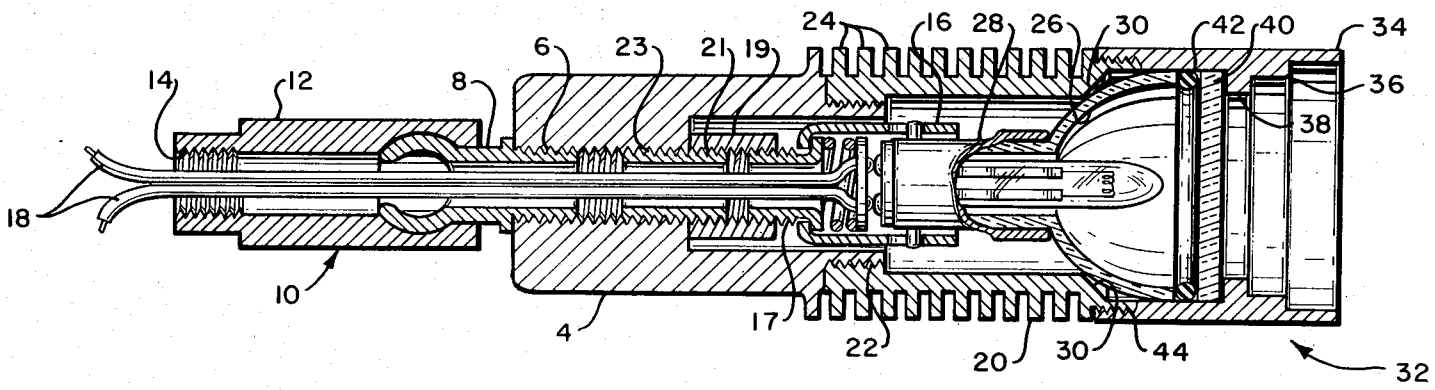
FIG. 2 is a cross-sectional view of the lighting instrument assembled from the component parts shown in FIG. 1, illustrative of this invention in its preferred embodiment.

The implementation of this invention in a preferred embodiment may be readily understood from an examination of FIG. 1 and FIG. 2, taken together, where the component parts of a lighting instrument as taught by this invention are shown in their relative relationship prior to assembly in the exploded view of FIG. 1, and are shown after assembly in the cross-sectional view of FIG. 2.

The basic building block of the instrument is the base body 4 into which is threaded a swivel mounting adaptor 10 having a main section 12 with internal threads 14 at the rear and a stem section 8 at the front having outside threads for mating at 6 with inside threads in the rear end of base body 4. Stem section 8 is arranged to swivel in at least one plane relative to the main section 12 under frictional constraint.

Base body 4 also mounts and partially houses a double contact bayonet lamp socket 16 which has an externally threaded tailpiece 17 threadedly joined by coupling 19 and nipple 21 to base body 4 at 23 in the front end of a central internally-threaded opening inside base body 4 as shown in FIG. 2. A pair of insulated flexible hookup wires 18 connected to the contacts of socket 16 pass thru a conduit formed by central openings in the socket tailpiece 17, coupling 19, nipple 21, base body 4 and the two sections 8 and 12 of swivel assembly 10, for external electrical connection.

A tubular midsection body 20 has inside threads at the rear mating with outside threads on the front of the base body 4, as shown at 22 in FIG. 2, and is fabricated with a series of lateral cooling ribs 24 around its outer surface. As shown in FIG. 1 and FIG. 2, the base body 4 has a flange at its front end shaped similar to each of the lateral cooling ribs 24 on the midsection body 20 such that when the base body 4 and the midsection body 20 are threadedly assembled together, the flange on the base body 20 appears as an additional cooling rib integrated in style with the midsection cooling ribs 24, tending to conceal the boundary line between base body 4 and midsection body 20.

The midsection body 20 surrounds a prefocussed reflector lamp 26 which is equipped with a bayonet base 28 mating with socket 16, and is cradled in place by a flared inner region at 30 near the front end of midsection housing 20. Accurate positioning of the lamp 26 against the flared inner region at 30 is accomplished by rotating lamp 26 and socket 16 so as to thread tailpiece 17 in or out of coupling 19, which is held in fixed relation to base body 4 by nipple 21.

Referring further to FIG. 2; in barrel assembly 32, the tubular barrel body 34 has an internal stepped flare configuration, widening toward the open front end, as shown at 36, to minimize secondary reflections and unwanted light dispersion, and has an internal circular flange 38 for supporting an optical disk 40, which in this example is a clear protective lens, held in place by a compliant O-ring retainer 42 pressed in place against it as shown. The barrel body 34 has inside threads at the rear, mating at 44 with outside threads at the front of midsection body 20, so that with lamp 26 in place the barrel assembly 32 may be coupled with midsection body 20 by threading onto it, to form the completed lighting instrument assembly.

Figure 3:
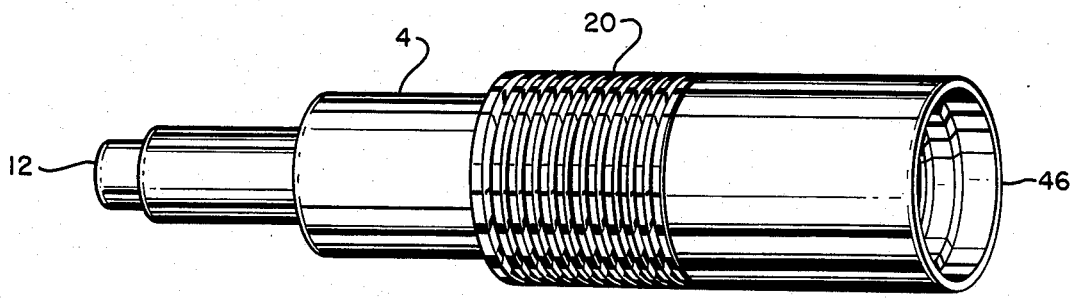
FIG. 3 is an external view of a lighting instrument in accordance with this invention similar to that shown in FIG. 1 and FIG. 2, except that it is configured with a long barrel section to produce a narrow-angle light beam for spotlighting.

Turning to FIG. 3, an exterior view is shown of a lighting instrument configured as a narrow-beam spotlight in accordance with the present invention. It is assembled as in FIG. 2 except for the use of a long barrel assembly 46 in place of the short barrel assembly 32 of FIG. 2. A narrow-angle reflector lamp is selected for this configuration to produce a narrow light beam of high intensity.

Figure 4:
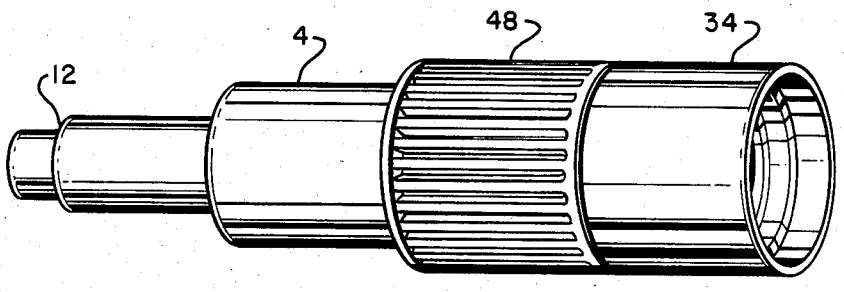
FIG. 4 is an external view of the lighting instrument of this invention assembled with a short barrel section in a wide-beam configuration similar to that shown in FIG. 1 and FIG. 2 except that the midsection body has fluted ribs.

FIG. 4 shows an exterior view of a lighting instrument in accordance with the present invention, in a wide-beam configuration, assembled as in FIG. 2 except that, as a styling alternative, midsection body 48 has fluted cooling ribs instead of the lateral cooling ribs shown on midsection body 20 in FIGS. 1, 2 and 3.

Figure 5:
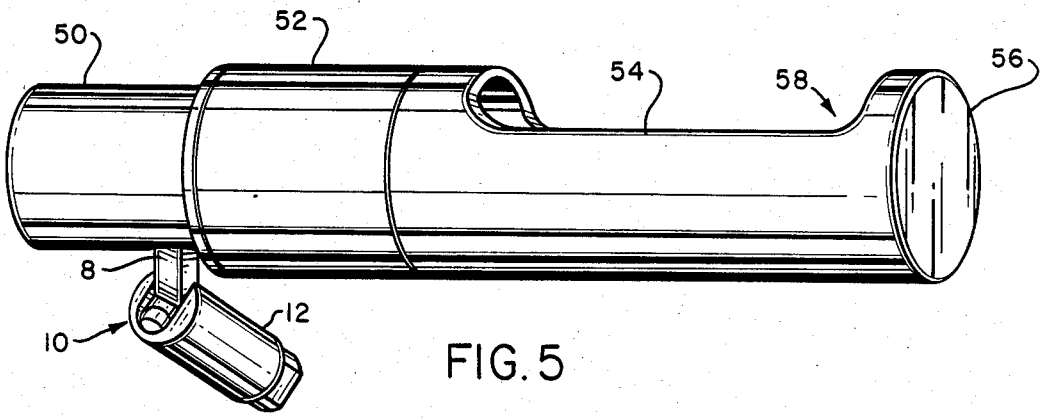
FIG. 5 shows the lighting instrument of this invention configured with a side-mounted swivel adaptor, a plain-surfaced midsection body. and an ultra-wide-angle side-throw barrel section.

FIG. 5 shows the exterior view of a lighting instrument in accordance with the present invention, in an ultra-wide-beam side-throw configuration differing from the configurations in the previous figures in that the swivel assembly 10 is threaded into the side of base body 50, the midsection body 52 has a smooth unribbed exterior surface, and the barrel assembly 54 has a large side aperture and a closed end 56. In this configuration the lighting efficiency and uniformity may be enhanced by providing an angled reflector located within the barrel assembly 54 in the region indicated at 58.

Figure 6:
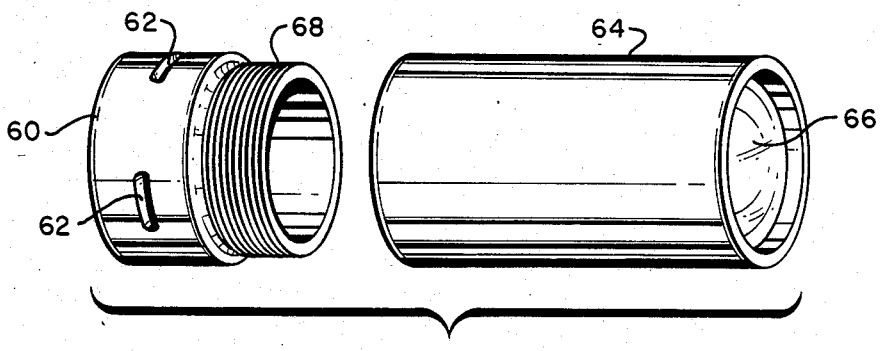
FIG. 6 shows a separated view of a projector barrel for providing the lighting instrument of this invention with image-projection and focusing capability.

FIG. 6 shows an optional projector barrel which may be used in place of the alternative barrel assemblies shown in the previous figures, to project images of a mask or template inserted as the optical disk 40 of FIG. 2. The projector barrel is configured in two sections, as shown in FIG. 6. The rear section 60 is provided with ventilation openings at 62 but otherwise configured internally like the rear portion of barrel body 34 in FIG. 2. The front section 64 is fitted with a projector lens 66 at the front end, and has internal threading at the rear mating with external threading at the front of the rear section 60, as shown at 68. With the two sections threaded together, focusing is accomplished by rotating the front section 64 while the rear section 60 remains fixed, thus varying the distance between the lens 66 and the internal reflector-lamp which remains in fixed relationship with rear section 60. The ventilation slots 62 provide additional convection cooling to allow for additional heating which may occur in opaque areas of optical disk 40.

In the preferred embodiment of the present invention, all of the body parts are machined from T6061 aluminum alloy, and are finished by anodizing. However other metals such as brass, or plastic material having suitable properties may be substituted, subject to thermal analysis.

The prefocused reflector-lamps are rated at 20 watts at 12 volts, 5500 candlepower high lumen output, 2000 hour life. The integral reflector lens is a dichroic mirror which reflects visible light while remaining relatively transparent to heat radiation, thus reducing the heat content radiated along with the light beam. Tungsten-halogen quartz lamp construction produces excellent spectral uniformity for natural color rendition of illuminated objects. Various beam width requirements are accommodated by chosing the reflector-lamp from three available types having different focal lengths as determined by the curvature of the ellipsoidal reflector lens: narrow (10 degrees), medium (17 degrees) and wide-angle (30 degrees). The reflector-lamps have 12 volt filaments; low voltage filments have become standard for high quality optical lamps because they are much more rugged and compact than high voltage filaments for standard 120 volt power line operation. Operation of lighting instruments of this invention from a 120 volt power line requires a 120/12 volt step-down isolation transformer, which renders the lighting instruments and their secondary wiring practically free of shock hazard.

The reflector-lamp is provided with a standard double-contact bayonet base 28, FIG. 1 and FIG. 2, to mate with socket 16.

The various optional configurations available for each of the three basic elements, the base body, the midsection body, and the barrel, provide a large number of potential combinations for synthesizing a broad range of different customized lighting instrument configurations which are style co-ordinated and which may be easily assembled, and later retrofitted if desired. Numerous artistic effects may be created by utilizing color filters, fixed or variable apertures, special masks and/or templates and the like as the optical disk 40, FIG. 1 and FIG. 2.

The range of potential utilization of this invention is greatly expanded by its versatility in combination with fiber-optics. A fiber-optic coupler is easily fitted in place of the barrel section, expanding the capabilities of the instrument to the creation of dramatic new decorative and display effects as well as the performance of sophisticated illumination tasks in industrial and scientific activities.

Variations, modifications and adaptations which may become apparent to those of skill in the art of optics and illumination without departing from the spirit of this invention are intended to be included within the scope of this disclosure.

What is claimed is:

1. A versatile miniature coaxialy-configured lighting assembly for architectural quality illumination and display purposes in residential and commercial environments, comprising, (a) a cylindrical base body, at least partially enclosing lamp connector means, said base body having an enclosed rear end, an outer cylinder wall region, and a front end having a forward-extending, outside-threaded, coaxial tubular flange, (b) a tubular midsection body having a rear end inside-threaded to mate with the outside-threaded flange at the front end of said base body, an outer wall region, an inner wall region, and a front end having a forward-extending, outside-threaded, coaxial tubular flange, (c) a low voltage prefocused reflector type lamp located within the front end of said midsection body, electrically and mechanically engaging the lamp connector means, (d) a tubular barrel having a rear end inside-threaded to mate with the ouside-threaded flange at the front end of said midsection body, an outer wall region, an inner wall region, and a front end, whereby said midsection body may be removably coupled in coaxial relationship with said base body by threading onto the front end of the base body, and whereby said barrel may be removably coupled in coaxial relationship with said midsection body by threading onto the front end of the midsection body.

2. The invention as in claim 1 further comprising a swivel mounting assembly having a stem section attached to said base body at its rear end in a central location, and a mounting section attachable to a fixed mounting object, the stem section and the mounting section being capable of swivelling in at least one plane with respect to each other under frictional constraint.

3. The invention as in claim 1 further comprising a swivel mounting assembly having a stem section attached to said base body at its outer wall region, and a mounting section attachable to a fixed mounting object, the stem section and the mounting section being capable of swivelling in at least one plane with respect to each other under frictional constraint.

4. The invention as in claim 1 wherein said midsection body is configured with a pattern of lateral circular cooling ribs along the length of its outer wall region.

5. The invention as in claim 4 wherein said base body is configured with a flange at its front end similar in appearance to each of the midsection cooling ribs, spaced and shaped such that after assembly, the flange appears as a continuum of the midsection cooling rib pattern, whereby the base body and the midsection body are made to appear as a single continuous unit.

6. The invention as in claim 1 wherein said midsection body is configured with fluted cooling ribs along the length of its outer wall region.

7. The invention as in claim 1 wherein the inner wall region of said midsection body is flared near the front end to form an enlarged throat at the front end in approximate conformance with the contours of the reflector lamp so as to provide mechanical support to the reflector lamp in its operational location.

8. The invention as in claim 1 wherein said inner wall region of said barrel is flared in a series of steps of increasing diameter near the front end forming an enlarged throat at the open end, Whereby secondary reflections from the inner barrel wall are minimized to avoid light beam boundary degradation due to unwanted dispersions.

9. The invention as in claim 1 wherein said midsection body and said barrel are made approximately 1.5 inches in outside diameter, and said midsection body is made approximately 1.5 inches in length.

10. The invention as in claim 9 wherein said barrel is made approximately 1.5 inches in length so as to produce a relatively wide angle light beam.

11. The invention as in claim 9 wherein said barrel is made approximately 2.25 inches in length so as to produce a relatively narrow angle light beam for spotlighting small areas.

12. The invention as in claim 9 wherein said barrel is approximately 4 inches in length, having its front end closed and having a large opening along one side so as to produce an ultra-wide-angle light beam for illuminating walls or other large areas.

13. The invention as in claim 1 wherein the inner wall of said barrel is configured to accept an optical disk such as a filter, diffuser, fixed or adjustable iris, special lens, clear protector or the like, the disk being retained on its front side by a concentric ring integral with said barrel and on its rear side by a compliant O-ring engaging the inner wall region, and the disk being removable or exchangable by uncoupling and recoupling said midsection body and said barrel.

14. The invention as in claim 13 wherein said barrel is configured as a projector barrel having a front barrel section and a rear barrel section, threadedly coupled to each other, the front barrel section having an optical lens mounted near its front end and the rear barrel section accepting an optical disk configured as a light mask with openings forming a desired pattern, the spacing between the lens and the light mask being adjustable by rotating the front barrel section relative to the rear barrel section, whereby a projected image of the desired pattern may be focused at a desired plane in an illuminated region.

15. The invention as in claim 1 wherein said barrel comprises fiber-optic coupling means whereby the lighting assembly of this invention is enabled to serve as a light source for a fiber-optic lighting system.

16. A process for assembling component parts of a coaxially-configured miniature lighting instrument designed particularly for architectural quality purposes in residential and commerical environments, in accordance with this invention, comprising the steps of (a) selecting a base body fitted with a lamp socket, (b) selecting a midsection body from a group of tubular midsection bodies having different configurations such as smooth, lateral-ribbed or fluted exterior surface, (c) attaching the selected midsection body onto the selected base body, using mating threads provided at the rear end of the midsection body and at the front end of the base body, (d) selecting a low voltage prefocused reflector lamp having light beam width suited to an intended illumination requirement, (e) inserting the selected lamp into the front end of the midsection body so as to engage the lamp socket located within the base body.

(f) selecting a tubular barrel from a group of barrels having different lengths for different light beam widths so as to best address the intended illumination requirement, (g) selecting at least one optical disk from a group comprising filters, diffusers, fixed iris, adjustable iris, special lenses, clear protector and the like, (h) inserting the optical disk into the rear end of the barrel and locating it against a mounting surface provided, (i) securing the optical disk in place by pressing a compliant O-ring into the barrel against the rear of the disk, (j) attaching the selected barrel onto the selected midsection body using internal threading provided at the rear end of the barrel to mate with external threading provided at the front end of the midsection body.

17. A process for modifying and focusing the lighting instrument of this invention after assembly as in claim 16, to enable the instrument to function as a projector, comprising the further steps of (k) selecting for the optical disk a light mask having openings corresponding with a particular pattern to be projected, (l) procuring a projector barrel assembly having (i) a front section containing a lens near the front end, (ii) a rear section threadedly coupled to the front section to provide focusing capability, and (iii) internal threading at the rear for mating with the externally threaded front end of the midsection body, (m) inserting the selected light mask into the rear end of the projector barrel assembly and placing it against a mounting surface provided, (n) securing the light mask in place by pressing a compliant O-ring into the projector barrel against the front side of the mask, (o) removing the previously selected barrel from the midsection body in a reversal of step (j), (p) threading the projector barrel onto the front end of the midsection body, (q) installing the lighting instrument in its working location, (r) energizing the lamp to produce an image at a designated plane in the field of illumination, and (s) focusing the image by rotating the front section of the projector barrel relative to the rear section.

* * * * *